US006773276B2

(12) United States Patent
Ziegler et al.

(10) Patent No.: US 6,773,276 B2
(45) Date of Patent: Aug. 10, 2004

(54) DEVICE FOR MEASURING AND/OR TESTING OF COMPONENTS OF OPTICAL AND/OR ELECTRICAL NETWORKS AND A LIFT DEVICE USED FOR THIS PURPOSE

(75) Inventors: Jochen Ziegler, Stuttgart (DE); Ralf Haefner, Holzgerlingen (DE); Alf Clement, Aidlingen (DE)

(73) Assignee: Agilent Technologies, Inc., Palo Alto, CA (US)

( * ) Notice: Subject to any disclaimer, the term of this patent is extended or adjusted under 35 U.S.C. 154(b) by 48 days.

(21) Appl. No.: 10/071,426

(22) Filed: Feb. 8, 2002

(65) Prior Publication Data

US 2002/0135382 A1 Sep. 26, 2002

(30) Foreign Application Priority Data

Feb. 15, 2001 (DE) ..... 101 06 959

(51) Int. Cl.[7] ..... H01R 13/44; H01R 13/80

(52) U.S. Cl. ..... 439/131

(58) Field of Search ..... 439/131, 180, 439/894

(56) References Cited

U.S. PATENT DOCUMENTS

| | | | | | |
|---|---|---|---|---|---|
| 3,188,415 | A | | 6/1965 | Netzel | 200/50 |
| 3,794,956 | A | * | 2/1974 | Dubreuil | 439/131 |
| 4,511,198 | A | * | 4/1985 | Mitchell et al. | 439/131 |
| 5,755,582 | A | * | 5/1998 | Charlton | 439/131 |
| 5,801,953 | A | * | 9/1998 | Thoma et al. | 702/68 |
| 6,086,390 | A | * | 7/2000 | Haut | 439/131 |
| 6,120,307 | A | * | 9/2000 | Nagel et al. | 439/131 |
| 6,475,003 | B2 | * | 11/2002 | Jones et al. | 439/131 |

FOREIGN PATENT DOCUMENTS

| | | |
|---|---|---|
| DE | OS 1 922 537 | 11/1969 |
| DE | 37 30 613 A1 | 3/1988 |
| DE | 38 34 363 C2 | 4/1990 |

* cited by examiner

*Primary Examiner*—Javaid H. Nasri

(57) ABSTRACT

A device for measuring and/or testing of components of optical and/or electrical networks includes a casing and an optical and/or electrical connection jack attached to the casing, to which an optical and/or electrical lead can be connected directly or indirectly via an adapter, wherein a lift device is provided, with which the connection jack can be moved relative to the casing between a lifted position and a lowered position.

29 Claims, 4 Drawing Sheets

DEVICE FOR MEASURING AND/OR TESTING OF COMPONENTS OF OPTICAL AND/OR ELECTRICAL NETWORKS AND A LIFT DEVICE USED FOR THIS PURPOSE

BACKGROUND OF THE INVENTION

Devices for measuring and/or testing components of optical and/or electrical networks are used, for example, to test or measure the performance and/or function of a component, e.g. wiring and/or components, of an optical and/or electrical network, i.e. a data network with optical and/or electrical data transmission. For example, individual components, on an electrical and/or optical basis, or optical and/or electrical data leads, e.g. glass fibers, may be characterized or measured and/or tested. In order to perform such testing or measurement, the component to be tested must be connected to a measuring and/or testing instrument of the device using an appropriate optical and/or electrical lead. For this purpose, the device has a suitable optical and/or electrical connection in the form of a connection jack, also called "connector". In order to be able to attach the respective lead to the connection jack of the device, the lead has a connector link, which on principle may be designed complementary to the connection jack. However, many different variations normally exist of the connector links that are permanently attached to the leads. In order for the different connector links to be connectable to the connection jack of the device, adapters are generally available that may be connected to the connection jack on the device on one side and to the respective variation of the connector link on the lead on the other side. Such an adapter is then provided for every common variation of connecting links on the cable side.

For traditional devices, for example the Agilent E6000 series by Agilent Technologies, the connection jack may be located on the back of the device while the front is equipped, for example, with controls and at least one display device, more particularly a screen. As the connection jack is on the back of the device and is often lowered or at least located in a way that the space for manually attaching or detaching the connection between the lead and the connection jack, or between lead and adapter, and between adapter and connection jack is relatively tight, attaching or detaching the connection requires patience and agility. Performing a large number of measurements can therefore be tedious, especially if many connections must be attached and detached for a measuring and/or testing task. A lowered position of the connection jack is preferred, especially when used with a cover, because the connection jack is relatively sensitive to contact and shock and the lowered position provides a certain protection. The adapter that might be used should also fit under the cover so that it does not have to be detached every time.

Other connection devices are known from DE-A-3730613, DE-A-1922537, DE-A-3834363 and U.S. Pat. No. 3,188,415.

SUMMARY OF THE INVENTION

The object of the present invention is to simplify the attachment and detachment of a connection between the connection jack and the lead.

The invention is based on the concept of designing the connection jack on the casing so that it might be lifted and lowered. For this purpose the device according to the invention is equipped with a lift device that can be used to adjust the position of the connection jack relative to the casing between a lifted and a lowered position. With this measure, the sensitive connection jack can be moved to its lowered position when it is not in use in which it is relatively well protected. If the connection jack is needed, however, to attach or detach a lead or an adapter, it can be moved to its lifted position in which it is much more accessible. Attaching and detaching of the connection between lead, adapter, and connection jack is thus made considerably easier.

The lift device is preferably equipped with spring devices that pre-tension the connection jack in its lifted position. The lift device is furthermore equipped with an engaging mechanism, triggered by pressure, that engages in the lowered position of the connection jack. A first pressure triggering moves the connection jack from its lifted to its lowered position, where the engaging mechanism locks, and a subsequent second pressure triggering releases the lock of the engaging mechanism so that the spring mechanism moves the connection jack to its lifted position. The proposed engaging mechanism makes the lift device particularly easy to operate and handle. This is especially advantageous when the connection jack is located on the back of a device and the lift device or the engaging mechanism must be operated virtually without visual contact. Looking back, the fundamental principle of such an engaging mechanism may be compared to the engaging mechanism of a ballpoint pen, for example, the push-button of which may be adjusted between two positions.

In a particularly advantageous embodiment, the lift device may be equipped with a safety device that creates a first lock when the connection jack reaches the lifted position, hindering the lowering of the connection jack. Release triggers are provided, which unlock the first lock and enable the connection jack to be lowered. In this embodiment, the first lock of the safety device secures the connection jack in its lifted position so that it cannot be moved to its lowered position automatically or unintentionally. This design is also of special importance if the adapter of the lead is connected through a socket or screw connection or a combined socket and screw connection because the locked lifted position in this case makes it impossible for the connection jack to be lowered by plugging in the adapter or the lead.

In another advantageous embodiment, the lift device can be equipped with the aforementioned, or a different, locking device that creates a second lock when the connection jack reaches its lowered position and thus hinders further lowering of the connection jack. Release triggers are also provided in this case, releasing the second lock when triggered and thus allowing the connection jack to be further lowered. This embodiment causes locking of the connection jack in its lowered position in order to avoid an undesired, automatic move of the connection jack to its lifted position. This embodiment also has a particular importance in the case where the adapter or the lead is connected to the connection jack with a socket and screw connection.

In an advantageous derivative, the electrical and/or optical connection between the connection jack and the lead attached to it, or between the connection jack and the adapter connected to it, functions in any position of the connection jack. In particular, it is therefore possible to move the connection jack back to its protected lowered position after the connection is made.

BRIEF DESCRIPTION OF THE DRAWINGS

The following gives a further description of the invention with reference to the drawings, wherein the same reference marks refer to identical, functionally identical, or similar features. It is shown schematically in FIG. 1 a perspective view of the device according to the invention with the connection jack lowered, FIG. 2 a view as in FIG. 1, but with the connection jack lifted, FIG. 3 a perspective exploded view of a preferred embodiment of a lift device of the device according to the invention.

DETAILED DESCRIPTION OF THE DRAWINGS

Figure 1:
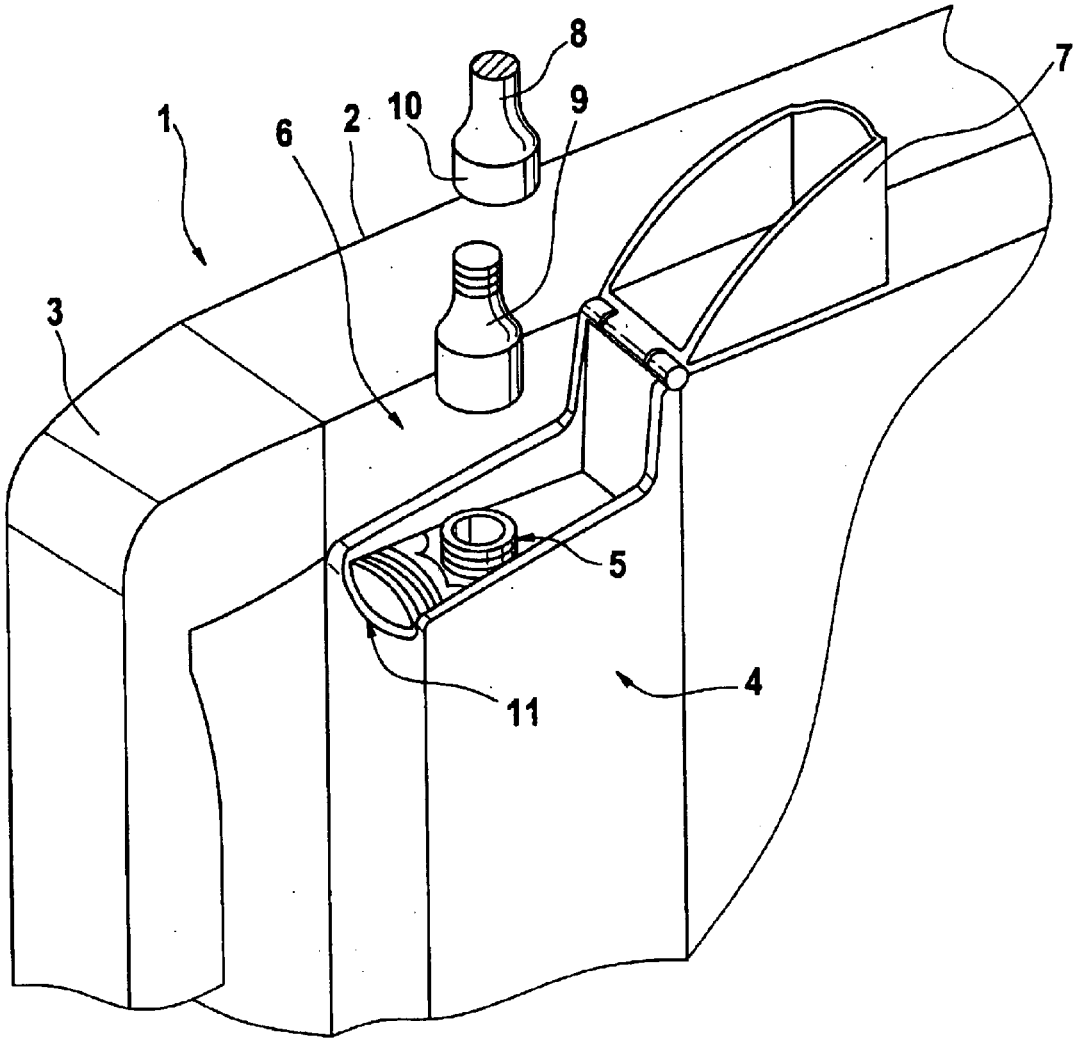
Figure 2:
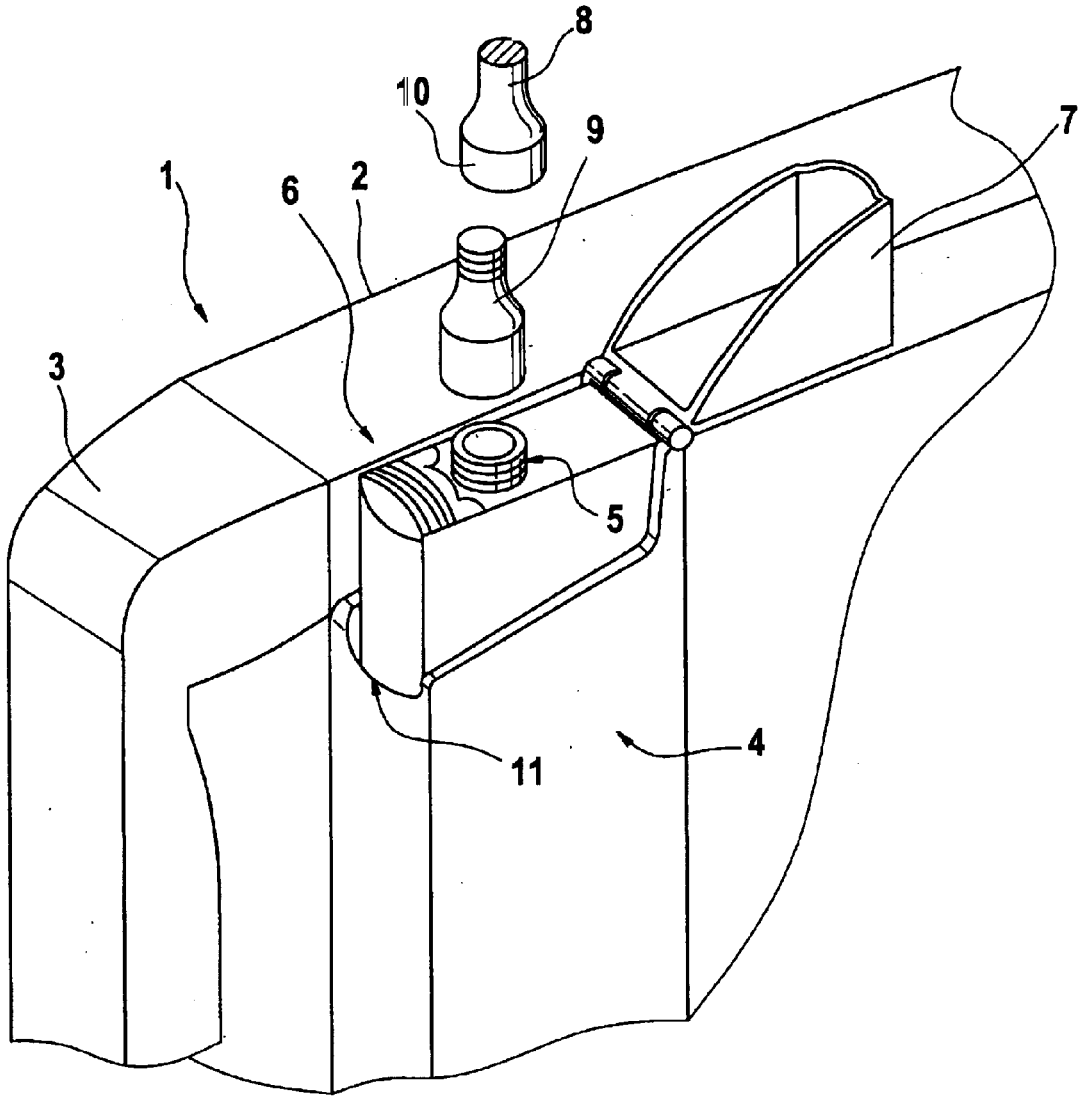
Figure 3:
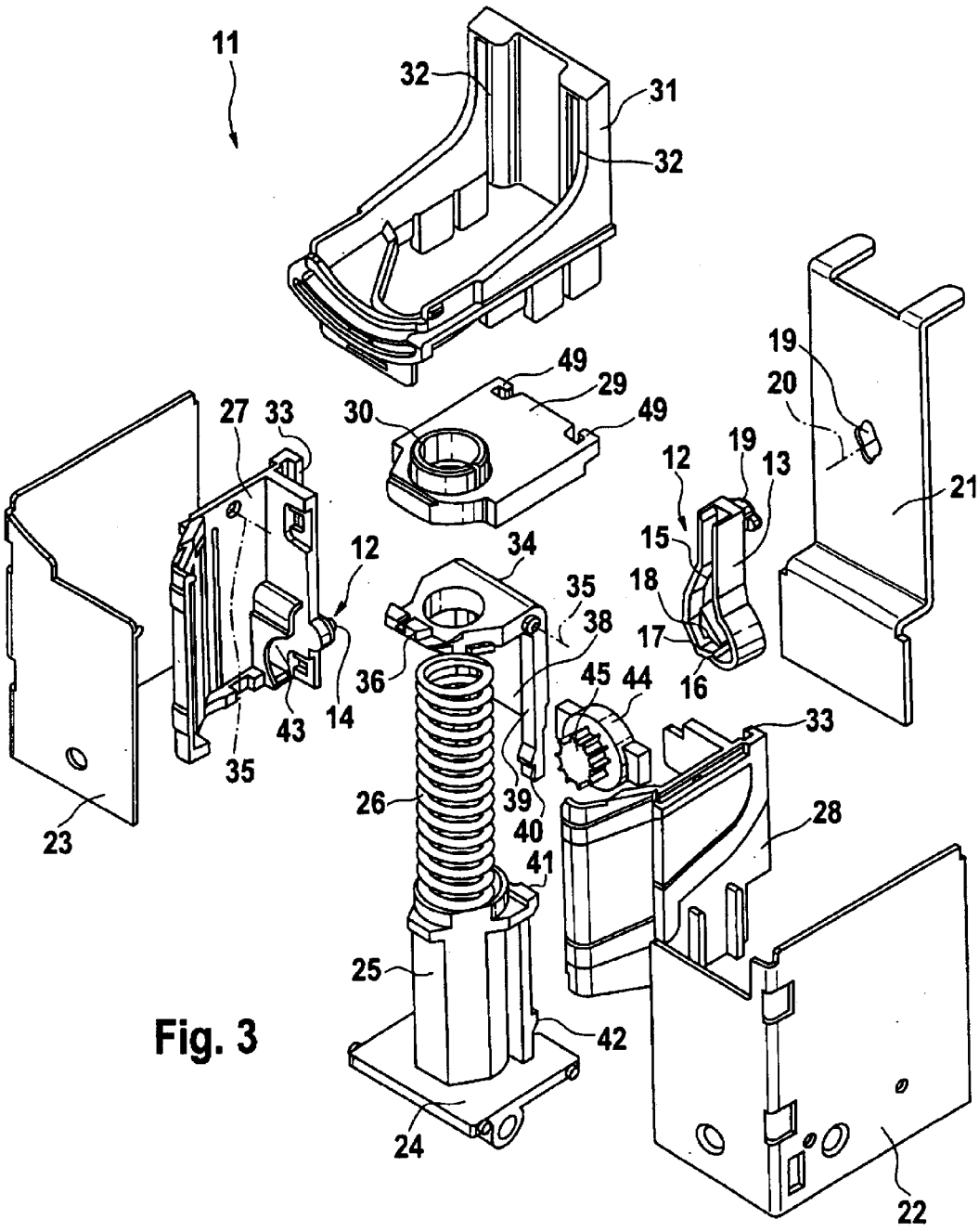

According to FIGS. 1 and 2, the device 1, only shown partially here, has a casing 2, which has handles 3 on either side. What is shown in this embodiment here is a portable variation for the device 1. However, the invention is also adaptable for use with stationary devices 1. The device 1 may comprise an electrical time domain reflectometer (TDR), or may be configured as such, which is used to characterize/measure an electrical cable, such as a co-axial transmission cable, telephone cable, or other supply, such as piping. The equipment 1 may equally comprise an optical time domain reflectometer (OTDR), or may be configured as such, which is used to characterize/measure the attenuation, homogeneity, splice waste, interruptions, the length, or the like of an optical fiber. Furthermore, the equipment 1 may comprise a wavelength division multiplexing (WDM) testing device, or may be configured as such, which can be used to characterize/measure wavelength division multiplexing signals.

The device 1 contains measuring and/or test equipment that is not visible here. These usually contain a programmed, or programmable, computer and storage medium. The measuring and/or testing device or the device 1 is designed for performing measuring and/or testing procedures or tasks used to test or measure optical and/or electrical networks or individual components of such a network, in particular optical/electrical elements and optical/electrical leads, such as glass fibers. For this purpose, the device 1 has regular control devices on its front at the far side from the viewer as well as a display device, for example in LCD display form. On the back 4 of the device 1 on the far side of the observer, an optical and/or electrical connection jack 5 is provided in the top side corner of the device 1, wherein the connection jack is attached to the aforementioned measuring and/or testing device by optical or electrical means. A recess 6, which can be sealed by means of a protective cap 7, is built into the casing 2 to build in this connection jack 5. In the drawings of FIGS. 1 and 2, this protective cap 7 is open. The protective cap 7 can be closed to protect the connection jack 5. The protective cap 7 then covers the recess 6 and the connection jack 5.

A lead 8 may be connected to the connection jack 5. This connection is normally done via an adapter 9, which is complementary to the connection jack 5 on one side and complementary to the connector link 10 on the other side, wherein the connector link is attached to the lead 8. With an appropriate construction, the lead 8 may also be connected directly to the connection jack 5 with its connector link 10.

The device 1 according to the invention is equipped with a lift device 11, which makes it possible to adjust the connection jack 5 between a lowered position, shown in FIG. 1, and a lifted position, shown in FIG. 2. In the lowered position according to FIG. 1, the connection jack 5 is relatively protected in the recess 6, thus preventing damage to the connection jack 5 by unintentional collision with a hard object. In this protected positioning of the lowered connection jack 5, it is relatively difficult to access so that a lot of effort is necessary to connect the adapter 9 or the lead 8 to the connection jack 5 or the device 1. In the lifted position, on the other hand, the connection jack 5 is in an exposed position according to FIG. 2, which ensures easy and convenient access to the connection jack 5. Attaching and detaching of the connection between the connection jack 5 and the adapter 9 or the lead 8 is thus made considerably easier.

As can be seen from FIGS. 1 and 2, the protective cap 7 can be sized such that the entire displacement space that is used by the connection jack 5 and the elements adjusted along with it can be covered by the protective cap 7. In other words, the protective cap 7 in this special embodiment can be properly closed even when the connection jack 5 is lifted according to FIG. 2. Furthermore, the size of the displacement or the displacement space that is used by the connection jack 5 and the element connected to it is suitably chosen such that the protective cap 7 can be closed properly even when an adapter 9 is connected to the connection jack 5 as long as the connection jack 5 is in its lowered position according to FIG. 1. In other words, a traditional adapter 9 only protrudes only so far over the top of the connection jack 5 that the protective cap 7 can still be closed properly when the connection jack 5 is in its lowered position.

According to FIGS. 3 to 6, the lift device 11 is equipped with an engaging mechanism 12 in a special embodiment, mainly consisting of a guiding link 13 and a gliding pin 14. The guiding slotted link 13 is equipped with a guiding groove 15 acting together with the gliding pin 14. This guiding groove 15 has a first stop 16 in its lower area and a second stop 17 in the lower area of the guiding groove 15 that is subsequent with respect to the adjustment direction of the gliding pin, which is clockwise. Above these stops, 16 and 17, the guiding groove 15 has a snap-in 18, which is between the stops, 16 and 17, with respect to the adjustment direction of the gliding pin 14.

Using an oscillating bearing 19, the guiding slotted link 13 is attached oscillating around an oscillating axis 20 perpendicular to the adjustment direction of the gliding pin 14. The bearing 19 has relatively high resistance in this case so that the guiding slotted link 13 does not move by itself. The guiding slotted link 13 is suspended from an immovable back wall 21 or a permanently connected back wall. This back wall 21 is part of an outer casing of the lift device 11. Other parts of this outer casing are designated 22 and 23. The outer casing 21, 22, 23 of the lift device 11 in this case is located inside the casing 2 of the device 1 according to FIGS. 1 and 2. A bottom plate 24 is permanently fixed to this outer casing and a sleeve 25 is mounted to the bottom plate 24. A coil spring 26 rests on this sleeve 25, pre-tensioning the lift device 11, driving the connection jack 5 to its lifted position.

The lift device 11 is also equipped with an inside casing with two halves, 27 and 28, and a cover plate 29. The cover plate 29 has a frame 30 to accommodate the connection jack 5 not shown in FIGS. 3 to 6. A connection line of this connection jack 5 leading into the inside of the device 1 may be led through the sleeve 25. The inside casing 27, 28, 29 forms a unit together with the connection jack 5. This unit may be adjusted relative to the outer casing 21, 22, 23 between the lowered position and the lifted position, wherein the outer casing is permanently attached to, or inside, the casing 2 of the device 1. The inside casing 27, 28, 29 penetrates a cover 31 that covers the top of the outer casing 21, 22, 23 in the recess 6 of the casing 2. Guiding tracks 32 are provided in this cover 31, working together with corresponding complementary protrusions 33 attached in the casing halves, 27 and 28, of the inside casing. The cover plate 29 is also equipped with hock-shaped protrusions 49, suspended in the guiding tracks 32.

Figure 4:
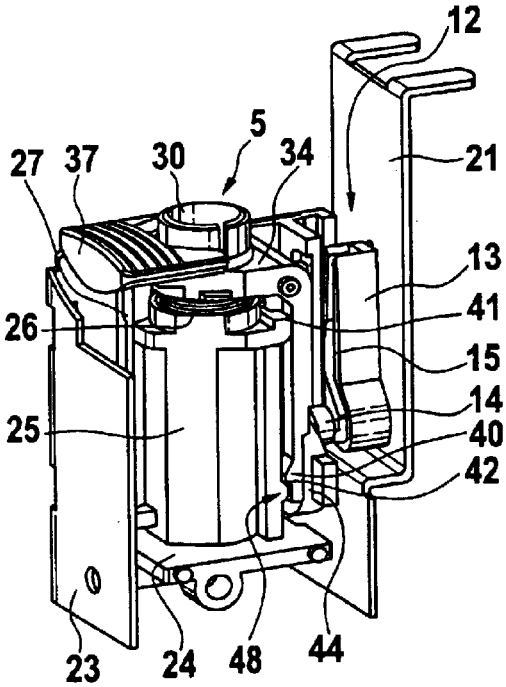
FIGS. 4, 5, and 6 different perspective views of the lift device according to FIG. 3, but in a state of advanced assembly.
Figure 5:
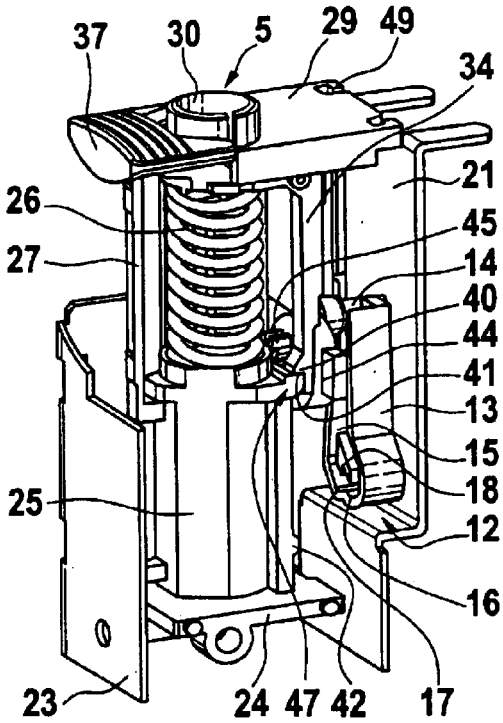
Figure 6:
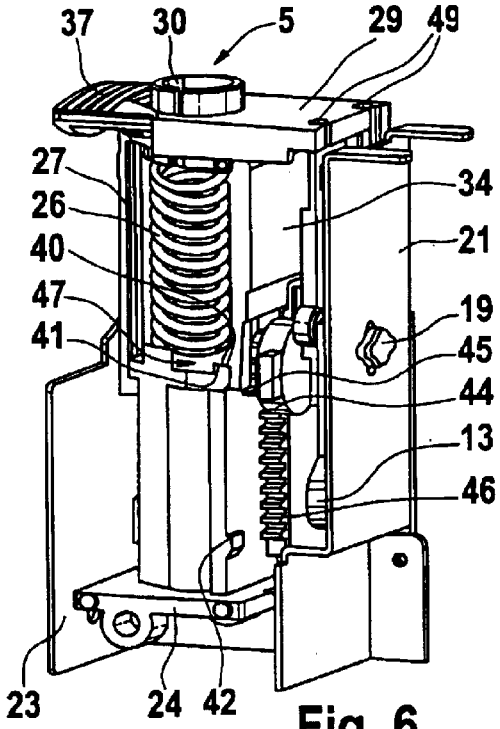

Furthermore, a lever 34 is attached in the inside casing, wherein the lever is suspended from the casing halves, 27 and 28, oscillating around a pivot 35, which is perpendicular to the lifting motion of the inside casing and perpendicular to the pendulum axis 20. On the end 36 of the lever that faces the cover plate 29, a control element 37, shown in FIGS. 4, 5, and 6, is attached to move the lever 34 in a tilting motion. Due to its function, the control element 37 will also be called release button 37 in the following. Two shanks 39 stick out from the lever 34 on the end 38 facing away from the cover plate 29. A locking nipple 40 is attached to each shank. For every one of these locking nipples 40, a first locking protrusion 41 on the top and a second locking protrusion 42 on the bottom are attached to the sleeve 25, which work together with the respective locking nipple 40 when assembled. The lever 34 together with the release button 37, the locking nipples 40, and the locking protrusions 41 and 42, forms a locking device, the functioning of which is explained further down.

The inside casing has a bearing 44 of a gear wheel 45 in frames 43, which are attached in the casing halves, 27 and 28. The gear wheel 45 works together with the gear rod 46, attached to the sleeve 25 and only seen in FIG. 6.

When assembled, the lift device 11 of FIGS. 3 to 6 works as follows:

The gliding pin 14 is attached in the inside casing. The casing half 28 facing the observer is not shown in FIGS. 4 and 5 in order to make the representation clearer. Accordingly, the gliding pin 14 is immovable with respect to the connection jack 5. In the lifted position, according to FIGS. 5 and 6, the gliding pin 14 is therefore in an upper area of the guiding groove 15. The locking nipples 40 are each engaged in the first locking protrusion 41 on the top. The connection jack 5, or the complete inside casing, is therefore locked in this lifted position. Forces directed from the top to the bottom that are exerted on the inside casing or the connection jack 5 therefore do not normally cause the connection jack 5 to be lowered. The connection jack 5 is fixed. With the locking nipple 40 locking into the first locking protrusion 41 on the top, a first locking 47 is created.

The locking device shown above can be equipped with an overload protection, which releases the first locking 47 if a force acts on the connection jack 5 or the inside casing towards the bottom and this force exceeds a pre-determined, permissible maximum force. Such an overload protection can be realized, for example, with a suitable shape of the locking nipple 40 and/or the first locking protrusion 41 on the top. The locking nipple 40 and/or the locking protrusion 41 can be positioned to each other with a certain incline, for example.

In order to move the connection jack 5 or the complete inside casing from the lifted position, according to FIGS. 5 and 6, to the lowered position, according to FIG. 4, the first locking 47 must be released first. For this purpose, the user triggers the release button 37, attached to the lever 34, so that the lever rotates around its pivot 35. This releases the locking nipple 40 from the first locking protrusion 41, releasing the first locking 47. When lowering the connection jack 5, the gliding pin 14 moves along with it inside the guiding groove 15 and hits the first stop 16 because of the position of the guiding slotted link 13. The inside casing, or the connection jack 5, is then in a first, lower reversing position, which is lower than the lowered position according to FIG. 4. When the user then lets go of the release button 37, the coil spring 26 drives the inside casing towards the top and the gliding pin 14 hits the snap-in 18 in the guiding groove 15. In this position of the gliding pin 14, the connection jack 5 assumes its lowered position according to FIG. 4. At the same time, the locking nipple 40 engages into the lower, second locking protrusion 42, creating a second locking 48. This second locking 48 has the effect that an additional force exerted on the inside casing, or on the connection jack 5, towards the bottom will not cause further lowering of the adjustable parts.

When triggering the release button 37 again, the lever 34 swings back to the position where the locking nipple 40 is released from the second locking protrusion 42, thus releasing the second locking 48. After this operation, the inside casing and the connection jack 5 can then be lowered to a second lower reversing position, which again is lower than the lowered position according to FIG. 4. The adjustment path is again limited on the bottom because the drive pin 14 hits the second stop 17 in the second, lower reversing position. When the user now lets go of the release button 37 again, the coil spring 26 can automatically lift the connection jack 5 and the entire inside casing.

The gear wheel 45 is suspended with relatively high resistance in its bearing 44 so that the automatic lifting process will not be performed uncontrollably fast. Since the gear wheel 45 is permanently attached to the moving inside casing on the one side and moves into gear with the gear rod 46 on the other side, which in turn is permanently attached to the sleeve 25, the automatic upward motion of the inside casing is damped by the resistance of the gear wheel 45, in particular by the resistance of the bearing. In this manner, the individual components of the lift device 11 are under relatively little stress so that the lift device 11 has a relatively long life. It also creates a certain comfort when using the lift device 11. With this property, a relatively high perceived value can also be created.

During the up and down motion of the gliding pin 14, the outline of the guiding groove 15 causes corresponding oscillating swivelling motions of the guiding slotted link 13 around its pendulum axis 20. In particular, the guiding slotted link 13 is aligned in the lifted position such that the gliding pin 14 does not take the path to the second stop 17, but rather the path to the first stop 16, when the gliding pin is subsequently lowered.

With suitable measures, the lift device 11 can be made water-proof and/or dust-proof.

What is claimed is:

1. A device for measuring and/or verifying components of optical and/or electrical networks, comprising:

a case;

an optical and/or electrical connection jack located on the case to which an optical guide and/or electrical lead can be connected directly or indirectly via an adapter; and a lift device with which the connection jack can be adjusted relative to the case between a lifted position and a lowered position, wherein the lift device is equipped with a spring mechanism that pre-tensions the connection jack in the lifted position and with an engaging mechanism that that can be operated by a pressure force in lowering direction and locks into the connection jack in its lowered position, wherein in a first pressure operation the connection jack is moved from its lifted position to its lowered position where the engaging mechanism is engaged, and a subsequent second pressure operation releases the locking of the engaging mechanism so that the spring mechanism moves the connection jack to its lifted position, wherein the engaging mechanism is equipped with a guiding link and an adjustable gliding pin therein, wherein at least one of (i) the gliding pin is stationary with respect to the connection jack, while the guiding link is stationary with respect to the case, or (ii) the guiding link is stationary with respect to the connection jack, while the gliding pin is stationary with respect to the case, wherein the guiding link is equipped with a guiding groove in which the gliding pin locks in and in which the gliding pin moves in an adjustment direction when the connection jack is lifted or lowered, and wherein the guiding groove is designed such that the gliding pin:

(a) comes into contact with a first stop in a first lower reversing position, which is lower than the lowered position, when the connection jack is lowered from its lifted position, (b) comes into contact with a lock in its lowered position, located after the first stop with respect to the adjustment direction the gliding pin, when the connection jack is subsequently lifted from this first lower reversing position, (c) comes in contact with a second stop in a second lower reversing position, located after the lock with respect to the adjustment direction of the gliding pin, when the connection jack is subsequently lowered from its lowered position, and (d) passes by the lock and reaches the lifted position when the connection jack is subsequently lifted from this second lower reversing position, wherein redirection mechanisms are provided that ensure that the gliding pin in the guiding groove is moved to the first stop rather than to the second stop when the connection jack is lowered from its lifted position.

2. A device according to claim 1, wherein the redirection mechanisms are created by suspending the guiding link swingable and shaping the guiding groove so that the gliding pin forces a swivel movement of the guiding link when it is lifted from the second lower reversing position to the lifted position, such that the guiding pin in the guiding groove is directed towards the first stop.

3. A device according to claim 2, wherein the guiding link is suspended swingable but with relatively high friction.

4. A device for measuring and/or verifying components of optical and/or electrical networks, comprising:

a case;

an optical and/or electrical connection jack located on the case to which an optical guide and/or electrical lead can be connected directly or indirectly via an adapter; and a lift device with which the connection jack can be adjusted relative to the case between a lifted position and a lowered position, wherein the lift device is equipped with a spring mechanism that pre-tensions the connection jack in the lifted position and with an engaging mechanism that that can be operated by a pressure force in lowering direction and locks into the connection jack in its lowered position, wherein in a first pressure operation the connection jack is moved from its lifted position to its lowered position where the engaging mechanism is engaged, and a subsequent second pressure operation releases the locking of the engaging mechanism so that the spring mechanism moves the connection jack to its lifted position, and wherein the lift device includes spring mechanisms, which pre-tension the connection jack to the lifted position, and the lift device is equipped with damping mechanisms that dampen a shifting motion of the connection jack created by the spring mechanisms.

5. A device according to claim 4, wherein the damping mechanisms are equipped with a gear wheel that is connected to a gear bar and rolls along the gear bar when the connection jack is lifted or lowered, and wherein the gear wheel has relatively high friction.

6. A device according to claim 4, wherein the lift device is equipped with a safety mechanism that creates a first locking when the lifted position of the connection jack is reached and hinders the lowering of the connection jack, and wherein a release mechanism is provided, which releases the first locking when triggered, thus allowing the connection jack to be lowered.

7. A device for measuring and/or verifying components of optical and/or electrical networks, comprising:

a case;

an optical and/or electrical connection jack located on the case to which an optical guide and/or electrical lead can be connected directly or indirectly via an adapter; and a lift device with which the connection jack can be adjusted relative to the case between a lifted position and a lowered position, wherein the lift device is equipped with a spring mechanism that pre-tensions the connection jack in the lifted position and with an engaging mechanism that that can be operated by a pressure force in lowering direction and locks into the connection jack in its lowered position, wherein in a first pressure operation the connection jack is moved from its lifted position to its lowered position where the engaging mechanism is engaged, and a subsequent second pressure operation releases the locking of the engaging mechanism so that the spring mechanism moves the connection jack to its lifted position, wherein the lift device is equipped with a safety mechanism creating a first locking when the lifted position of the connection jack is reached and hinders the lowering of the connection jack, wherein a release mechanism is provided, releases the first locking when triggered, thus allowing the connection jack to be lowered, and wherein the safety mechanism has an overload protection that releases the first locking if a force is exerted in lowering direction on the connection jack or on a construction part of the lift device connected to it and this force is larger than a permissible force.

8. A device for measuring and/or verifying components of optical and/or electrical networks, comprising:

a case;

an optical and/or electrical connection jack located on the case to which an optical guide and/or electrical lead can be connected directly or indirectly via an adapter; and a lift device with which the connection jack can be adjusted relative to the case between a lifted position and a lowered position, wherein the lift device is equipped with a spring mechanism that pre-tensions the connection jack in the lifted position and with an engaging mechanism that that can be operated by a pressure force in lowering direction and locks into the connection jack in its lowered position, wherein in a first pressure operation the connection jack is moved from its lifted position to its lowered position where the engaging mechanism is engaged, and a subsequent second pressure operation releases the locking of the engaging mechanism so that the spring mechanism moves the connection jack to its lifted position, wherein the lift device is equipped with a safety mechanism creating a second locking when the lowered position of the connection jack is reached and hinders a further lowering of the connection jack, and wherein a release mechanism is provided, which releases the second locking when triggered, thus allowing the connection jack to be lowered.

9. A device for measuring and/or verifying components of optical and/or electrical networks, comprising:

a case;

an optical and/or electrical connection jack located on the case to which an optical guide and/or electrical lead can be connected directly or indirectly via an adapter; and a lift device with which the connection jack can be adjusted relative to the case between a lifted position and a lowered position, wherein the lift device is equipped with a spring mechanism that pre-tensions the connection jack in the lifted position and with an engaging mechanism that that can be operated by a pressure force in lowering direction and locks into the connection jack in its lowered position, wherein in a first pressure operation the connection jack is moved from its lifted position to its lowered position where the engaging mechanism is engaged, and a subsequent second pressure operation releases the locking of the engaging mechanism so that the spring mechanism moves the connection jack to its lifted position, wherein the lift device is equipped with a safety mechanism creating a first locking when the lifted position of the connection jack is reached and hinders the lowering of the connection jack, wherein a release mechanism is provided, which releases the first locking when triggered, thus allowing the connection jack to be lowered, wherein the safety mechanism includes a swingable lever, which is stationary with respect to the connection jack and wherein the lever may be driven by the release mechanism on one side of its suspension and is equipped with at least one locking nipple on the other side of its suspension, and wherein in the lifted position of the connection jack, the locking nipple locks into the first locking ledge, which is stationary with respect to the case, creating the first locking, and/or locks into a second locking ledge, which is stationary with respect to the case, creating the second locking, when the connection jack is in its lowered position.

10. A device according to claim 9, wherein the electrical and/or optical connection between the connection jack and the connected lead, or between the connection jack and the adapter connected to it works in any position of the connection jack.

11. A device for measuring and/or verifying components of optical and/or electrical networks, comprising:

a case;

an optical and/or electrical connection jack located on the case to which an optical guide and/or electrical lead can be connected directly or indirectly via an adapter; and a lift device with which the connection jack can be adjusted relative to the case between a lifted position and a lowered position, wherein the lift device is equipped with a spring mechanism that pre-tensions the connection jack in the lifted position and with an engaging mechanism that that can be operated by a pressure force in lowering direction and locks into the connection jack in its lowered position, wherein in a first pressure operation the connection jack is moved from its lifted position to its lowered position where the engaging mechanism is engaged, and a subsequent second pressure operation releases the locking of the engaging mechanism so that the spring mechanism moves the connection jack to its lifted position, and wherein a cover cap is suspended from the case that can cover a lifting space in which the connection jack can be adjusted.

12. A device according to claim 11, wherein the lifting space of the connection jack is chosen such that an adapter connected to the connection jack is inside the lifting space in the lowered position.

13. A device according to claim 11, wherein the device includes a time domain reflectometer or is designed as a time domain reflectometer.

14. A device according to claim 11, wherein the device includes an optical time domain reflectometer or is designed as an optical time domain reflectometer.

15. A device according to claim 11, wherein the device includes a wave division multiplexer or is designed as a wave division multiplexer.

16. An apparatus for lifting and lowering an electrical or optical connection jack of a device for measuring and or verifying components of optical and/or electrical networks, the apparatus comprising:

spring mechanisms that pre-tension the connection jack in a lifted position relative to a case of the device;

an engaging mechanism, operated by a pressure force in lowering direction, wherein the engaging mechanism locks in the lowered position of the connection jack relative to the case, and with a first pressure triggering, the connection jack is moved from its lifted position to its lowered position, in which the engaging mechanism locks, and a second pressure triggering releases the locking of the engaging mechanism so that the spring mechanisms move the connection jack to its lifted position; and damping mechanisms that dampen a shifting motion of the connection jack created by the spring mechanisms, wherein the damping mechanisms are equipped with a gear wheel that is connected to a gear bar and rolls along the gear bar when the connection jack is lifted or lowered, and wherein the gear wheel has relatively high friction.

17. The apparatus of claim 16, wherein the engaging mechanism is equipped with a guiding link and an adjustable gliding pin therein, wherein at least one of (i) the gliding pin is stationary with respect to the connection jack, while the guiding link is stationary with respect to the case, or (ii) the guiding link is stationary with respect to the connection jack, while the gliding pin is stationary with respect to the case, wherein the guiding link is equipped with a guiding groove in which the gliding pin locks in and in which the gliding pin moves in an adjustment direction when the connection jack is lifted or lowered, and wherein the guiding groove is designed such that the gliding pin:

(a) comes into contact with a first stop in a first lower reversing position, which is lower than the lowered position, when the connection jack is lowered from its lifted position, (b) comes into contact with a lock in its lowered position, located after the first stop with respect to the adjustment direction of the gliding pin, when the connection jack is subsequently lifted from this first lower reversing position, (c) comes into contact with a second stop in a second lower reversing position, located after the lock with respect to the adjustment direction of the gliding pin, when the connection jack is subsequently lowered from its lowered position, and (d) passes by the lock and reaches the lifted position when the connection jack is subsequently lifted from this second lower reversing position, wherein redirection mechanisms are provided that ensure that the gliding pin in the guiding groove is moved to the first stop rather than to the second stop when the connection jack is lowered from its lifted position.

18. The apparatus of claim 17, wherein the redirection mechanisms are created by suspending the guiding link swingable and shaping the guiding groove so that the gliding pin forces a swivel movement of the guiding link when it is lifted from the second lower reversing position to the lifted position, such that the guiding pin in the guiding groove is directed towards the first stop.

19. The apparatus of claim 18, wherein the guiding link is suspended swingable but with relatively high friction.

20. The apparatus of claim 16, further comprising:

a safety mechanism that creates a first locking when the lifted position of the connection jack is reached and hinders the lowering of the connection jack, and wherein a release mechanism is provided, which releases the first locking when triggered, thus allowing the connection jack to be lowered.

21. The apparatus of claim 20, wherein the safety mechanism has an overload protection that releases the first locking if a force is exerted in lowering direction on the connection jack or on a construction part of the lift device connected to it and the force is larger than a permissible force.

22. The apparatus of claim 20, wherein the safety mechanism includes a swingable lever, which is stationary with respect to the connection jack and wherein the lever may be driven by the release mechanism on one side of its suspension and is equipped with at least one locking nipple on the other side of its suspension, and wherein in the lifted position of the connection jack, the locking nipple locks into the first locking ledge, which is stationary with respect to the case, creating the first locking, and/or locks into a second locking ledge, which is stationary with respect to the case, creating the second locking, when the connection jack is in its lowered position.

23. The apparatus of claim 16, further comprising:

a safety mechanism creating a second locking when the lowered position of the connection jack is reached and hinders a further lowering of the connection jack, and wherein a release mechanism is provided, which releases the second locking when triggered, thus allowing the connection jack to be lowered.

24. The apparatus of claim 16, wherein the electrical and/or optical connection between the connection jack and the connected lead, or between the connection jack and the adapter connected to it works in any position of the connection jack.

25. The apparatus of claim 16, wherein a cover cap is suspended from the case that can cover a lifting space in which the connection jack can be adjusted.

26. The apparatus of claim 25, wherein the lifting space of the connection jack is chosen such that an adapter connected to the connection jack is inside the lifting space in the lowered position.

27. The apparatus of claim 16, wherein the device includes a time domain reflectometer or is designed as a time domain reflectometer.

28. The apparatus of claim 16, wherein the device includes an optical time domain reflectometer or is designed as an optical time domain reflectometer.

29. The apparatus of claim 16, wherein the device includes a wave division multiplexer or is designed as a wave division multiplexer.

* * * * *